US007505725B2

(12) United States Patent
Katayama et al.

(10) Patent No.: US 7,505,725 B2
(45) Date of Patent: Mar. 17, 2009

(54) IMAGE HEATING APPARATUS INCLUDING A RETRACTABLE PRESSURE BELT WITH DEVIATION CONTROL

(75) Inventors: Hiromasa Katayama, Toride (JP); Kazuhisa Okuda, Tokyo (JP); Michiaki Endo, Abiko (JP); Masahiko Yokota, Abiko (JP); Shinsuke Ubayashi, Kashiwa (JP); Takatoshi Chiba, Kashiwa (JP); Hiromitsu Uchida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 11/461,133

(22) Filed: Jul. 31, 2006

(65) Prior Publication Data

US 2007/0059061 A1 Mar. 15, 2007

(30) Foreign Application Priority Data

Sep. 13, 2005 (JP) ..... 2005-266117

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 5,027,160 A * 6/1991 Okada et al. ..... 399/329
5,070,373 A 12/1991 Fukano et al. ..... 355/290
5,153,655 A * 10/1992 Suzuki et al. ..... 399/329
5,964,339 A 10/1999 Matsuura et al. ..... 198/810.03
2004/0190958 A1* 9/2004 Matsumoto ..... 399/329
2006/0083562 A1* 4/2006 Matsumoto et al. ..... 399/329
2006/0133869 A1* 6/2006 Sata ..... 399/329
2007/0059059 A1* 3/2007 Fujino ..... 399/329
2007/0059062 A1 3/2007 Endo et al. ..... 399/329
2007/0059064 A1 3/2007 Okuda et al. ..... 399/329

FOREIGN PATENT DOCUMENTS

JP 2-157880 6/1990

* cited by examiner

*Primary Examiner*—David M Gray
*Assistant Examiner*—Joseph S. Wong
(74) *Attorney, Agent, or Firm*—Fitzpatrick, Cella, Harper & Scinto

(57) ABSTRACT

An apparatus for inclining a roller on which a pressure belt is suspended to perform a deviation control of the pressure belt, which can well perform the deviation control of the pressure belt even when the pressure belt has been spaced apart from a fixing roller. A fixing device is provided with a pressure belt suspended on rollers, a deviation control device adjusting the deviation of the pressure belt, and a pressure unit bringing the pressure belt into pressure contact with a fixing roller to form a nip portion. The deviation control device is designed to be moved with the pressure unit.

3 Claims, 12 Drawing Sheets

IMAGE HEATING APPARATUS INCLUDING A RETRACTABLE PRESSURE BELT WITH DEVIATION CONTROL

BACKGROUND OF THE INVENTION

1. Field of the Invention

The invention relates to an image heating apparatus for heating an image on a recording material. As such image heating apparatus, mention can be made of a fixing apparatus for fixing an unfixed image on a recording material, or a gloss improving apparatus for heating an image fixed on a recording material to thereby improve the degree of glossiness of the image.

2. Description of the Related Art

Heretofore, in an image forming apparatus such as a printer or a copying machine using an electrophotographic printing material, there has been provided a fixing apparatus for fixing a toner image on a sheet.

In Japanese Patent Application Laid-Open No. H02-157880, as such a fixing apparatus, there is proposed one using a belt. An example of the conventional belt fixing apparatus will be shown below.

The conventional belt fixing apparatus 100 shown in FIGS. 6, 7 and 8 of the accompanying drawings is constituted by a fixing unit 100A having a fixing roller 101 provided with a halogen heater (not shown) therein, and a belt conveying apparatus 133. The belt conveying apparatus 133 is constituted by a pressure unit 100B, a release cam 108, a deviation control driving portion 115, etc. The pressure unit 100B has a suspension roller 102 and a tension roller 103 as suspension members for circulating a suspended pressure belt 104.

The opposite ends of the rotary shaft 102*a* of the suspension roller 102 are rotatably supported on a pair of supporting metal plates 105 by antifriction bearings (not shown). The opposite ends of the rotary shaft 103*c* of the tension roller 103 are also rotatably supported on a pair of slide metal plates 106 by antifriction bearings (not shown). The slide metal plates 106 are slidably provided on the supporting metal plates 105. The slide metal plates 106 are biased away from the supporting metal plates 105 by tension springs 107. Therefore, the suspension roller 103 is biased away from the tension roller 104 to thereby give a tensile force to the pressure belt 104.

Also, when a pair of release cams 108 (one of which is not shown) are rotated by a pulse motor (not shown) the pressure unit 100B is adapted to be rotated about a pivot shaft 109 and is moved toward and away from the fixing roller 101 as a nip forming member.

As shown in FIG. 8, a driving force from a drive source 110 is inputted to the pressure belt 104 of the pressure unit 100B through an idler gear 111 on the pivot shaft 109. Therefore, the pressure unit 100B has the driving force inputted thereto whether it is in a pressed state or in a spaced-apart state relative to the fixing roller 101.

Such a fixing apparatus 100 presses the pressure belt 104 of the pressure unit 100B against the fixing roller 101 of the fixing unit 100A to thereby form a fixing nip portion between the fixing roller 101 and the pressure belt 104. The fixing nip portion, when a recording material S bearing an unfixed toner image thereon is conveyed thereto, nips and heats the sheet as the recording material together with the toner image. The recording material S is pressurized and heated, whereby the toner image thereon is fixed.

As described above, the fixing apparatus 100 using the belt enables the nip width in the conveyance direction of the recording material S to be wider than in a fixing apparatus (not shown) using a pair of rollers comprising a fixing roller and a pressure roller, and can obtain high fixing performance.

The endless belt of such a belt conveying apparatus, when it is circulated, may sometime be deviated in the width direction thereof crossing the circulation direction of the belt. Usually, the deviation of the belt is continued until as shown in FIG. 9 of the accompanying drawings, the pressure belt 104 comes into contact with a deviation restricting flange 112 provided on an end portion of a roller and the deviation thereof is restricted. In this case, however, the slide edge portion of the pressure belt 104 and the flange 112 may sometimes rub against each other and the side edge portion may be shaved thereby.

The main cause of the belt being circulated while being deviated is largely the inclination difference between the suspension members such as the suspension roller 102 and the tension roller 103 which are not disposed in parallelism to each other. In other words, by changing the inclination of the suspension members, it is possible to control the deviation direction of the belt.

So, the deviation of the belt can be adjusted if the deviation information of the belt is obtained from deviation detecting sensors 113*a* and 113*b* disposed in opposed relationship with the side edges 104*a* and 104*b* of the pressure belt 104 (see FIG. 8) to thereby change the inclination of the tension roller 103. The changing of the inclination of the tension roller 103 is accomplished by moving only one end portion of the tension roller 103 up and down by a deviation control arm 114 rotated in a vertical direction by a deviation control driving portion 115.

The deviation control of the belt will now be specifically described with reference to FIGS. 10, 11 and 12 of the accompanying drawings. When the pressure belt 104 is rotated in the direction indicated by the arrow A and becomes deviated in the direction indicated by the arrow B, the deviation detecting sensor 113*a* detects the side edge 104*a* of the pressure belt 104 to thereby detect the deviation of the pressure belt 104. On the basis of the result of the detection, a controlling portion (not shown) controls the operation of the deviation control driving portion 115 and rotates the deviation control arm 114 by a predetermined value in a clockwise direction as viewed in FIG. 7. Thereupon, the end portion 103*a* on this side of the tension roller 103 rises in the direction indicated by the arrow C as shown in FIG. 11, and the pressure belt 104 deviates in the direction indicated by the arrow D.

The inner part side refers to the side on which the drive source 110 is disposed. Also, this side refers to the side on which the deviation control driving portion 115 is disposed.

The end portion 103*b* on the inner part side of the tension roller 103 is tiltably fixed to the slide metal plate 106 disposed on the inner part side. The end portion 103*a* on this side of the tension roller 103 extends through the longitudinal slot 106*a* (see FIG. 7) of the slide metal plate 106 and is vertically movable. Accordingly, the tension roller 103 is designed such that the end portion 103*a* on this side is vertically moved with the end portion 103*b* on the inner part side as a fulcrum and the tension roller 103 is inclined as a whole.

When as shown in FIG. 12, the pressure belt 104 deviates in a direction opposite to the direction indicated by the arrow B, the deviation detecting sensor 113*b* (see FIG. 8) detects the other side edge 104*a* of the pressure belt 104. On the basis of the result of the detection, the controlling portion (not shown) controls the operation of the deviation control driving portion 115 and rotates the deviation control arm 114 by a predetermined value in a counter-clockwise direction as viewed in FIG. 7. Thereupon, the end portion 103*a* on this side of the tension roller 103 lowers in the direction indicated by the arrow E as shown in FIG. 12, and the pressure belt 104 deviates in the direction indicated by the arrow F.

As described above, the belt conveying apparatus 133 continues the operation of vertically moving the end portion 103*a* on this side of the tension roller 103 while the pressure belt 104 is circulated, whereby it can control the deviation of the pressure belt and circulate the pressure belt 104 to a substantially predetermined position.

In the above-described belt fixing apparatus, however, with the termination of the fixing operation, such an inconvenience as will be described below has occurred when the pressure belt 104 has been spaced apart from the fixing roller 101. That is, when standby rotation is performed with the pressure belt spaced apart from the fixing roller, disorder has occurred to the deviation control of the belt.

When in FIG. 7, the pressure belt 104 is brought into pressure contact with the fixing roller 101, the release cam 108 is rotated to thereby move the supporting metal plate 105 and the slide metal plate 106 toward the fixing roller 101. At this time, the suspension roller 102 rises integrally with the supporting metal plate 105. However, the end portion 103*b* on the inner part side of the tension roller 103 rises integrally with the slide metal plate 106 on the inner part side, but the end portion 103*a* on this side is received by the deviation control arm 114 and does not rise. Accordingly, the tension roller 103 is changed in its inclined state relative to the suspension roller 102. Therefore, there has occurred the necessity of operating the deviation control arm 114 to thereby readjust the inclination of the tension roller 103 to its original inclination.

Also, when as shown in FIG. 13 of the accompanying drawings, the tension roller 103 is received with the deviation control arm 114 lowered, the end portion 103*a* on this side of the tension roller 103 will not rise even if the release cam 108 is rotated to thereby move the two metal plates 105 and 106 toward the fixing roller 101. Therefore, the pressure force of the nip portion cannot be made into a desired pressure force. So, there has occurred the necessity of elevating the end portion 103*a* on this side of the tension roller 103 to thereby provide a desired pressure force.

That is, in the conventional construction, the deviation control driving portion 115 is discrete from the pressure unit 100B and therefore, when one of the operation of moving the pressure belt toward and away from the fixing roller and the operation of displacing the tension roller 103 is performed, the other operation has been affected.

So, as shown in FIG. 14A of the accompanying drawings, it is conceivable that when the nip portion is released from pressure, the direction in which the inclination of the tension roller 103 is changed relative to the direction indicated by the arrow H in which the tension roller 103 is moved, for the purpose of deviation control, be made orthogonal to the direction indicated by the arrow I. In this case, however, there arises another problem that by the inclination of the tension roller 103 being changed, a tension force applied to the pressure belt 104 is greatly changed.

Also, when as shown in FIG. 14B of the accompanying drawings, the direction in which the inclination of the tension roller 103 is changed (the direction indicated by the arrow J) and the direction in which the tension roller 103 is moved are the same direction indicated by the arrow K, there arises another problem that the deviation control arm 114 becomes a hindrance to the release of pressure during the release of the pressure force.

Also, in both of these methods, there has been the problem that when one of the operation of moving the pressure belt toward and away from the fixing roller and the operation of displacing the tension roller 103 is performed, the other operation is affected.

SUMMARY OF THE INVENTION

It is an object of the present invention to provide an image heating apparatus in which when a belt unit has been moved to a retracted position, the belt can be properly moved in the width direction thereof.

Also, it is an object of the present invention to provide an image heating apparatus having a heating rotary member for heating an image on a recording material in a nip portion; a belt unit provided with an endless belt forming the nip portion between itself and the heating rotary member, and a supporting member for supporting the inner surface of the belt; and a displacement mechanism, which displaces the supporting member so that the belt may be moved in the width direction thereof, wherein when the belt unit is moved to a position retracted from a position capable of heating the image, the displacement mechanism is moved with the belt unit.

Further features of the present invention will become apparent from the following description of exemplary embodiments (with reference to the attached drawings).

DESCRIPTION OF THE EMBODIMENTS

An image heating apparatus and an image forming apparatus according to embodiments of the present invention will hereinafter be described with reference to the accompanying drawings.

(Image Forming Apparatus)

Figure 5:
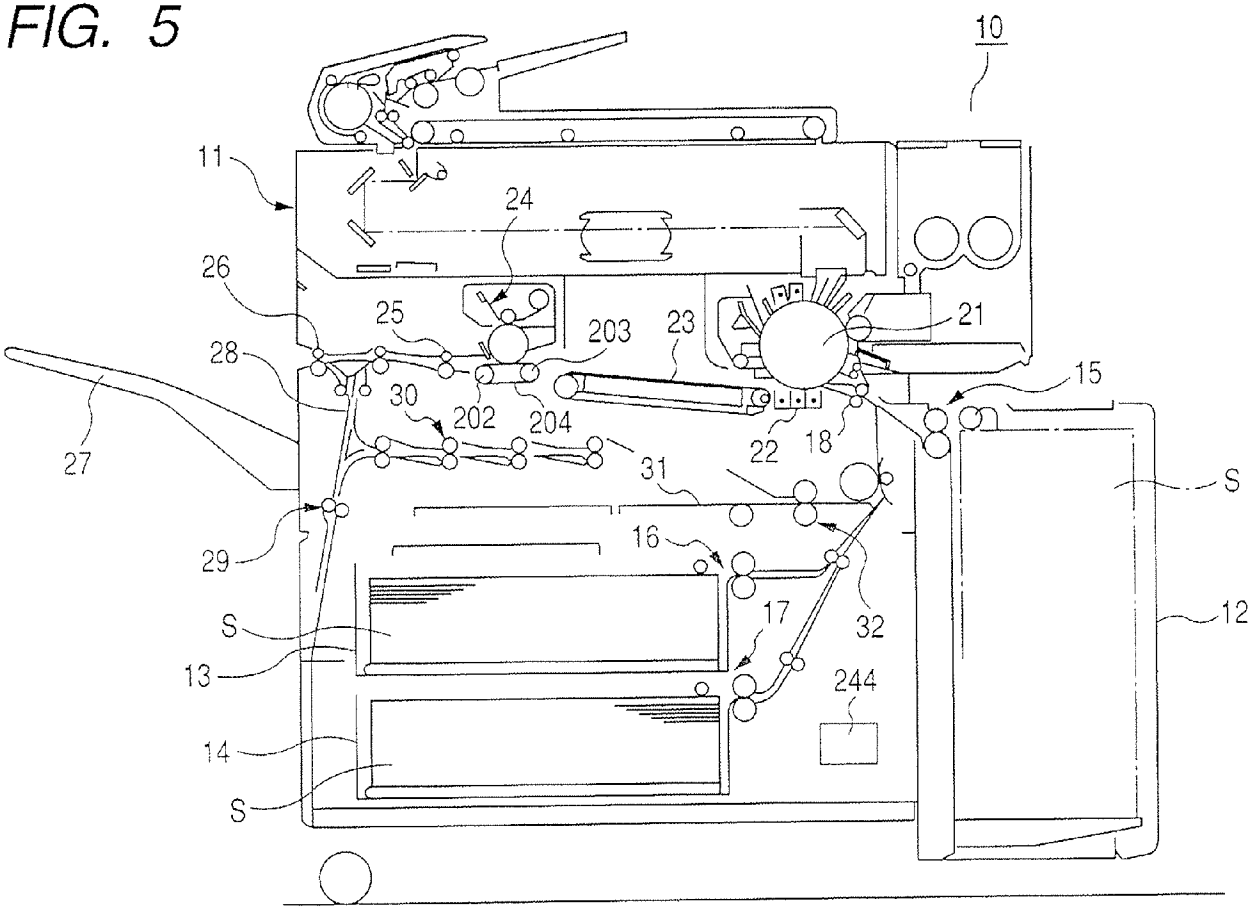
FIG. 5 is a schematic front cross-sectional view of a printer as an image forming apparatus according to an embodiment of the present invention.
Figure 6:
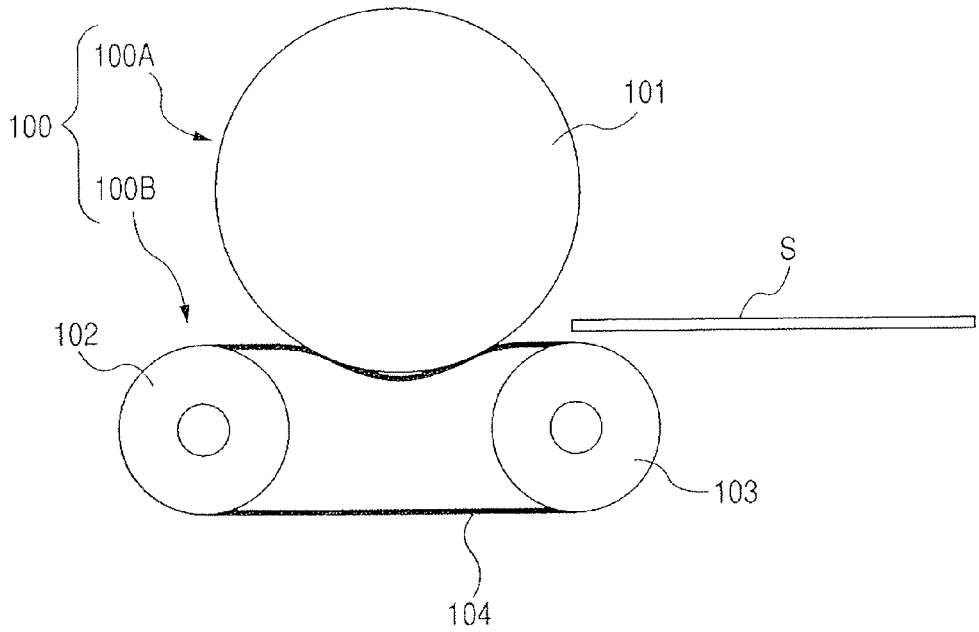
FIG. 6 is a schematic front view of a fixing apparatus as a conventional image heating apparatus.
Figure 7:
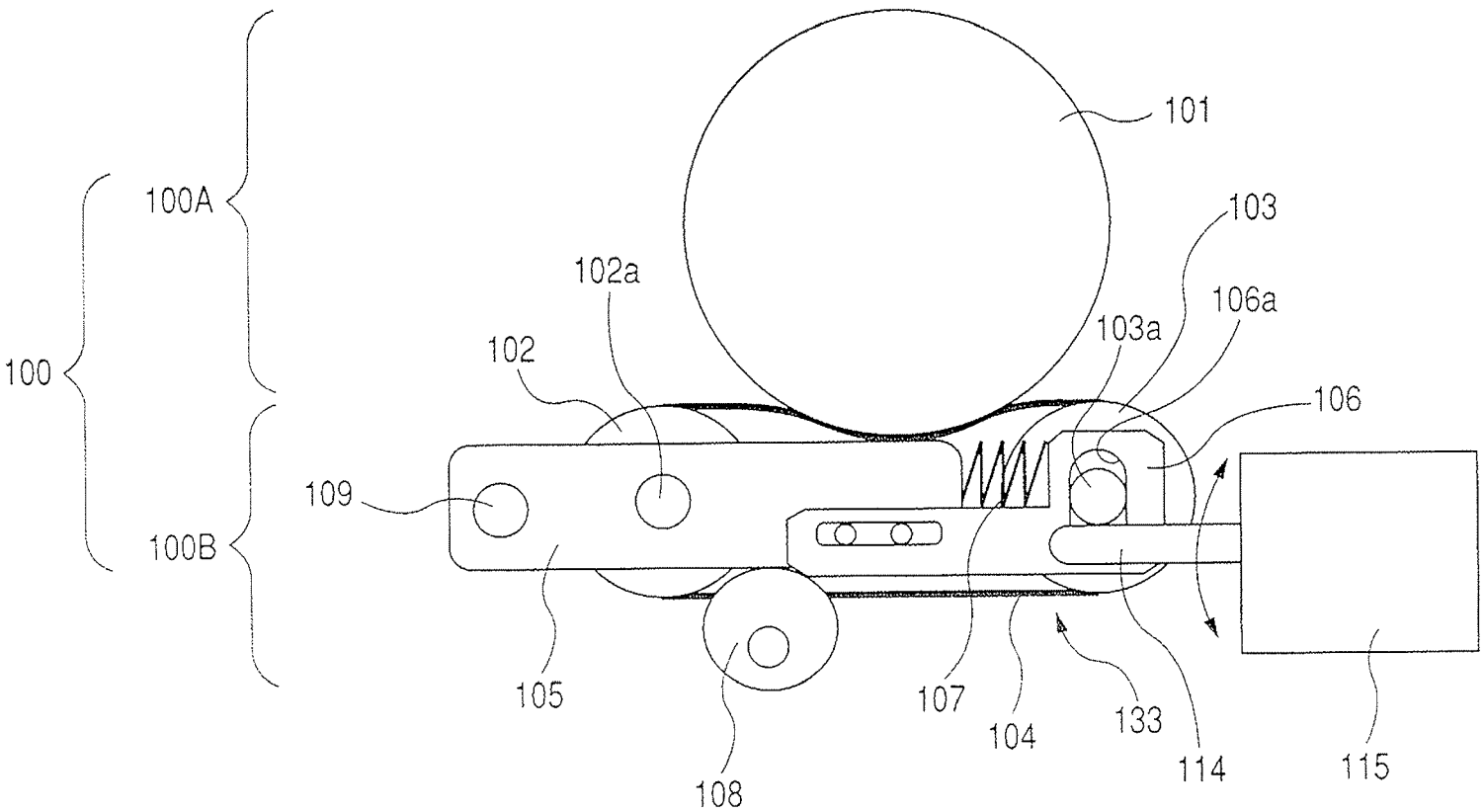
FIG. 7 is a detailed view of the fixing apparatus of FIG. 6.
Figure 8:
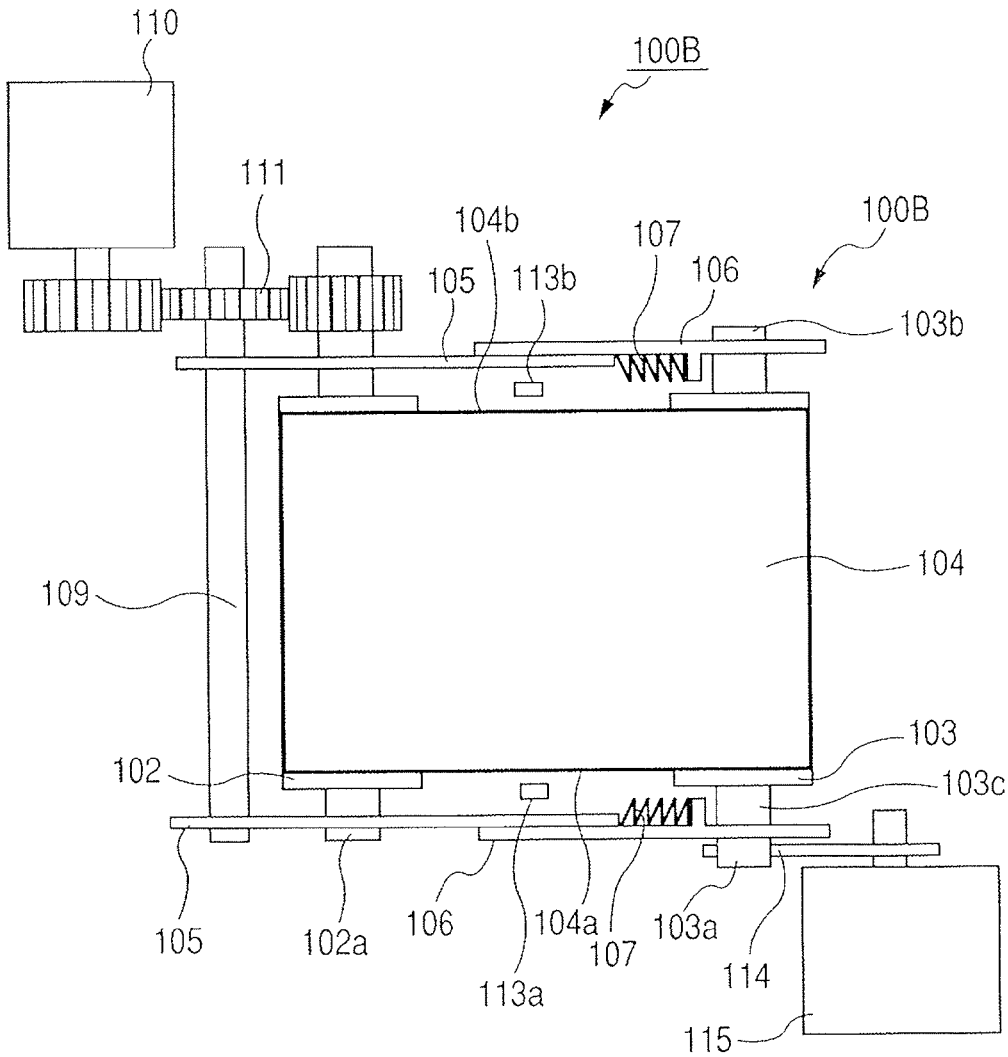
FIG. 8 is a plan view of the fixing apparatus of FIG. 7.
Figure 9:
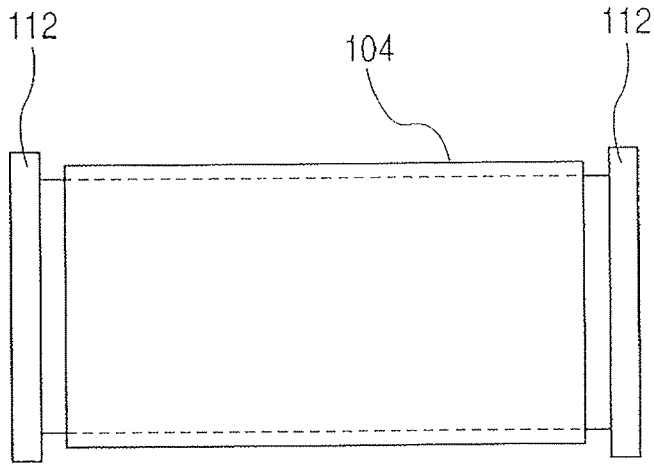
FIG. 9 shows a case where the deviation of a belt is prevented by a flange.
Figure 10:
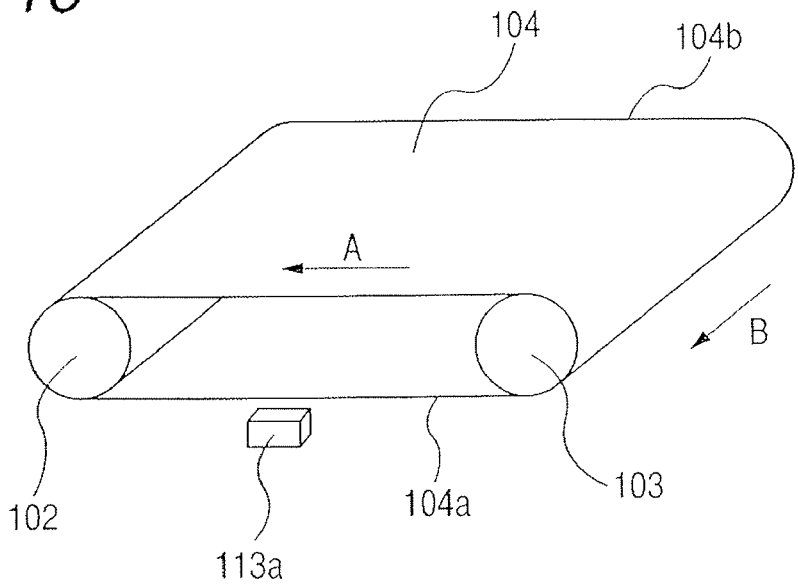
FIG. 10 is a view for illustrating the adjustment of deviation when in conventional belt conveyance, the belt is moved in the direction indicated by the arrow B.
Figure 11:
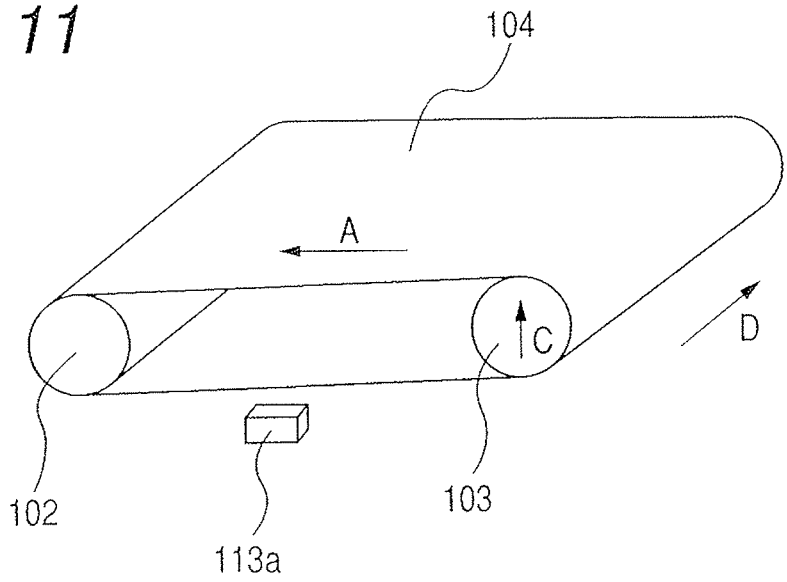
FIG. 11 is a view for illustrating the adjustment deviation when in the conventional belt conveyance, the belt is moved in the direction indicated by the arrow B in FIG. 10.
Figure 12:
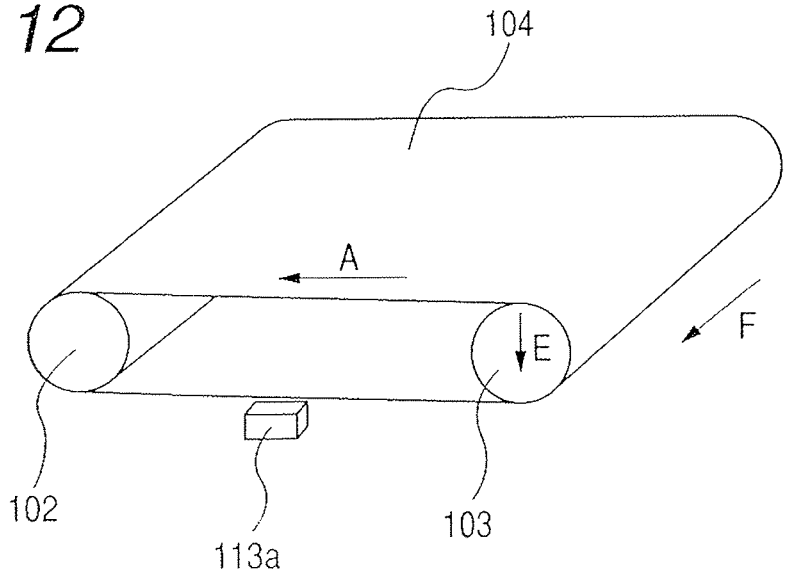
FIG. 12 is a view for illustrating the adjustment of deviation when in the conventional belt conveyance, the belt is moved in a direction opposite to the direction indicated by the arrow B in FIG. 10.
Figure 13:
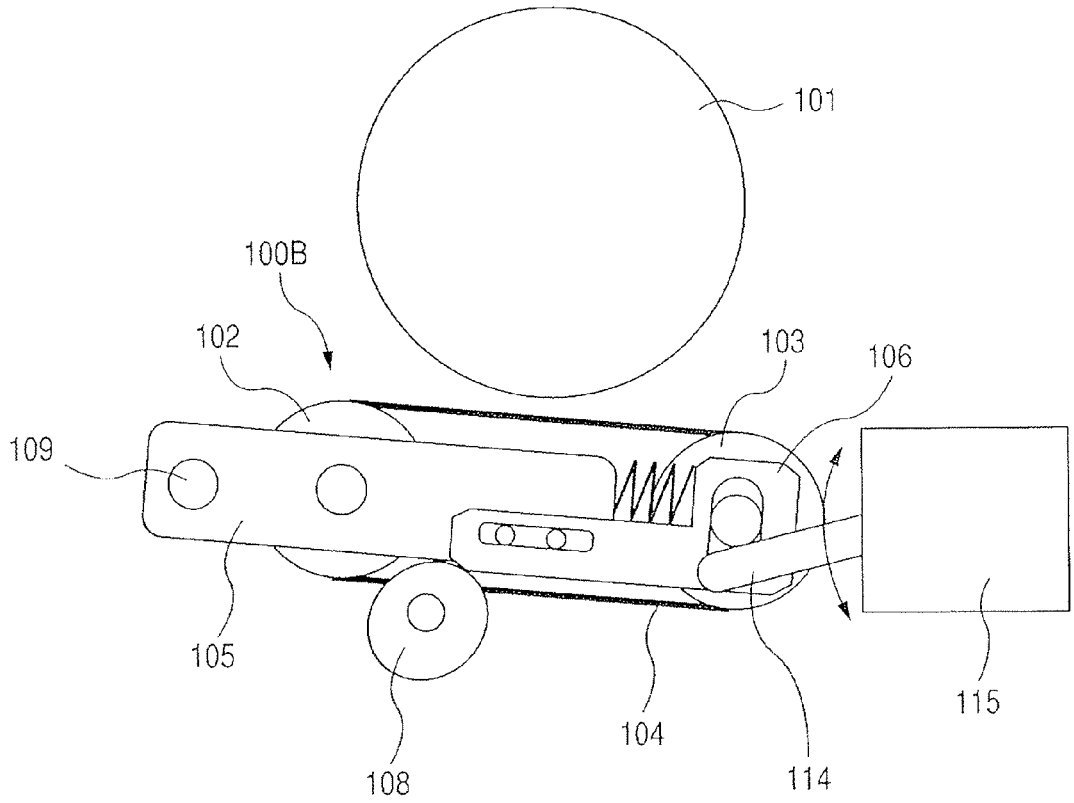
FIG. 13 shows a state in which a pressure unit is separated from a fixing unit in FIG. 7.
Figure 14A:
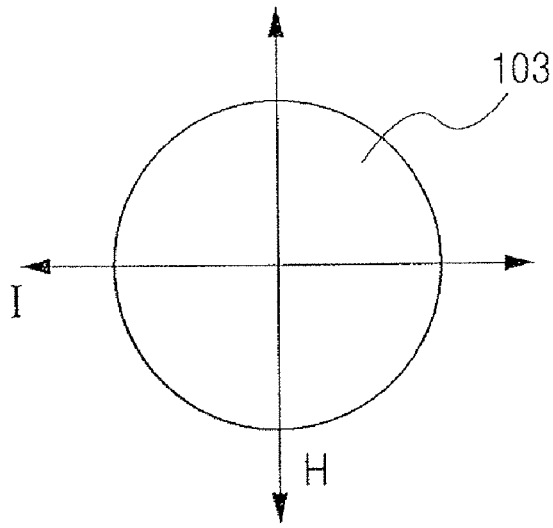
FIGS. 14A and 14B are illustrations of the adjustment of the deviation of the belt in the conventional belt conveyance.
Figure 14B:
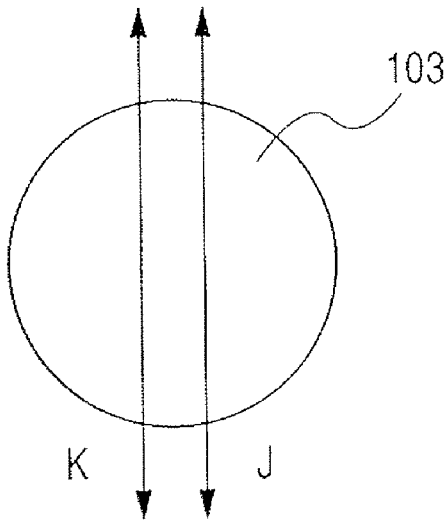

FIG. 5 is a cross-sectional view of a printer as an image forming apparatus adopting an electrophotographic printing method according to an embodiment of the present invention. Image forming apparatuses include a printer, a copying machine, a facsimile apparatus and a compound machine of these. Therefore, the image forming apparatus of the present invention is not restricted to a printer.

On one side portion of the apparatus main body 11 of the printer 10, there is provided a feeding deck 12 on which sheets S as a great deal of recording materials are stacked. In the lower portion of the interior of the apparatus main body 11 of the printer 10, there are provided a plurality of feeding cassettes 13 and 14 in which a predetermined amount of sheets S is contained. At the installation regions of the feeding deck 12 and the feeding cassettes 13 and 14, there are provided feeding devices 15, 16 and 17 of a retard separation type for feeding the sheets S.

A sheet S in the feeding deck 12 or the feeding cassette 13 or 14, when fed by the respective feeding device 15, 16 or 17, is conveyed to a pair of registration rollers 18 being at a halt, and has its skew feed corrected there.

Then, the sheet S is conveyed to between a photosensitive drum 21 and a transfer charger 22 as a transferring portion by the pair of registration rollers 18 rotated in timed relationship with a toner image on the photosensitive drum 21 as the image bearing member of an image forming portion, and the toner image is transferred thereto. Thereafter, the sheet S is conveyed to a fixing apparatus 24 as an image heating apparatus by a conveying belt 23, and the toner image thereon is fixed.

The printer 10 is provided with a two-side copying mode for performing two-side copying on the sheet S and a multiplex copying mode for performing multiplex copying, but in the case of an ordinary copying mode (one-side copying mode), the sheet S after the fixing process is discharged onto a discharging tray 27 outside the machine by a pair of inner discharging rollers 26.

Also, in the case of the two-side copying mode and the multiplex copying mode, the sheet is temporarily contained on an intermediate tray 31 by a pair of inner discharging rollers 25 or a pair of switchback rollers 29 through a refeeding path 28 and a two-side conveying path 30.

Then, the sheet S contained on the intermediate tray 31 is again conveyed to the pair of registration rollers 18 for image formation by a refeeding device 32, whereafter it is discharged out of the machine via the same process as one-side copying. The operation of the printer 10 is performed by a command from a controlling portion 244.

The printer 10 is provided with the fixing apparatus which can easily perform the fixing adjustment of the toner image onto the sheet as will be described later and therefore, can enhance the image formation working ratio.

(Fixing Apparatus)

The fixing apparatus as the image heating apparatus according to an embodiment of the present invention will now be described with reference to FIGS. 1, 2, 3 and 4. A belt conveying apparatus 33 provided in the fixing apparatus 24 greatly differs from the conventional belt conveying apparatus in that a pressure unit 24B is provided with a deviation control device 230 as a displacement mechanism.

The fixing apparatus 24 is constituted by a fixing unit 24A having a fixing roller 201 as a nip forming member provided with a halogen heater (not shown) therein, and the belt conveying apparatus 33. The belt conveying apparatus 33 is constituted by the pressure unit 24B as a belt unit, the deviation control device 230 as the displacement mechanism, and a release cam 108.

The pressure unit 24B has a suspension roller 202 and a tension roller 203 as members for suspending a pressure belt 204 thereon.

The opposite ends of the rotary shaft 202*c* of the suspension roller 202 are rotatably supported on a pair of supporting metal plates 205 by antifriction bearings (not shown). The opposite ends of the rotary shaft 203*c* of the tension roller 203 are also rotatably supported on a pair of slide metal plates 206 by antifriction bearings (not shown). The slide metal plates 206 are slidably provided on the supporting metal plates 205 by pins 234 and slots 235. The pins 234 are protrudingly provided on the supporting metal plates 205. The slots 235 are formed in the slide metal plates 206. The slide metal plates 206 are biased away from the supporting metal plates 205 by tension springs 207 and exert a tensile force on the pressure belt 204.

Also, design is made such that when a pair of release cams 208 (one of which is not shown) are rotated by a pulse motor (not shown), the pressure unit 24B is moved toward and away from the fixing roller 201 with a pivot shaft 209 as the center.

Figure 2:
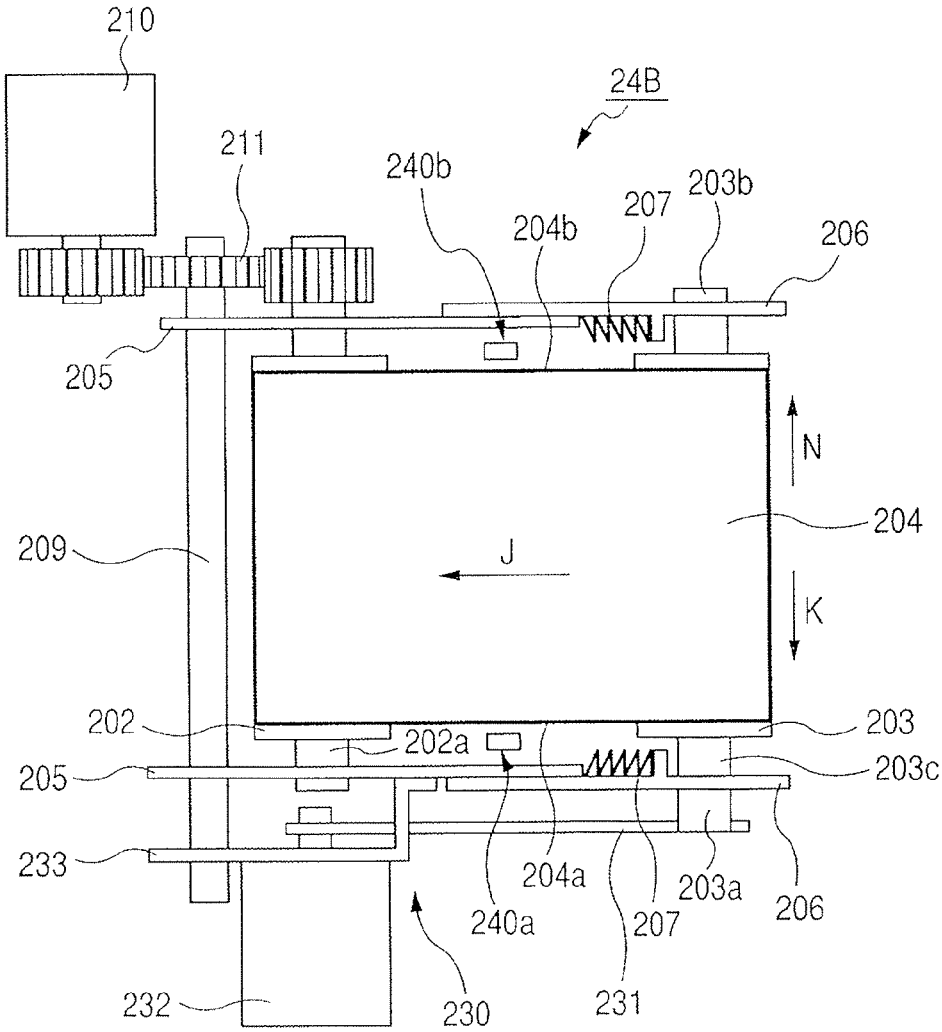
FIG. 2 is a plan view of the fixing apparatus of FIG. 1.

As shown in FIG. 2, a driving force from a drive source 210 is inputted to the pressure belt 204 of the pressure unit 24B through an idler gear 211 on the pivot shaft 209. Therefore, the pressure unit 24B has the drive inputted thereto whether it is in a pressurized state or in a released state relative to the fixing roller 201. That is, the rotation of the pressure belt is continued even during the standby after the fixing operation has been terminated and the pressure unit has been moved so as to space the pressure belt apart from the fixing roller. That is, the deviation control by a deviation control device 230 which will be described later is also performed when the pressure belt is being rotated during the standby.

(Deviation Control Device)

The deviation control device 230 as a displacement mechanism has a deviation control arm 231 for displacing the end portion 203*a* on this side of the tension roller 203 in a vertical direction. Further, it has a pulse motor (hereinafter referred to as the deviation control driving portion) 232 as a drive motor for pivotally moving the deviation control arm 231, and a motor supporting metal plate 233 for supporting the deviation control driving portion 232.

The inner part side refers to the side on which the drive source 210 is disposed. Also, this side refers to the side on which the deviation control device 230 is disposed.

The motor supporting metal plate 233 has one end thereof supported by a supporting metal plate 205, and has the other end thereof pivotally supported by the pivot shaft 209. Also, the position of the center G of gravity of the deviation control device 230 is set more toward the pivot shaft 209 than L/2 which is a half of the full length of the pressure unit 24B. By thus disposing the center G of gravity, it is possible to mitigate the influence imparted to the force when the pressure unit 24B is pressurized or released by the weight of the deviation control device 230.

Deviation detecting sensors 240*a* and 240*b* as detecting means for detecting the position of the pressure belt 204 in the width direction thereof are disposed in opposed relationship with each other on the side edges 204*a* and 204*b* of the pressure belt 204 in the width direction thereof crossing the circulation direction of the pressure belt 204.

Figure 3A:
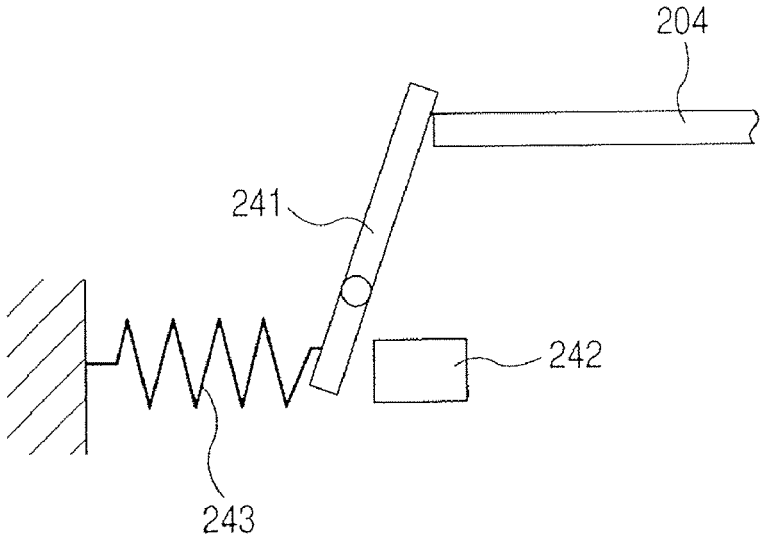
FIG. 3A is a schematic view of a deviation detecting sensor when it does not detect a pressure belt.
Figure 3B:
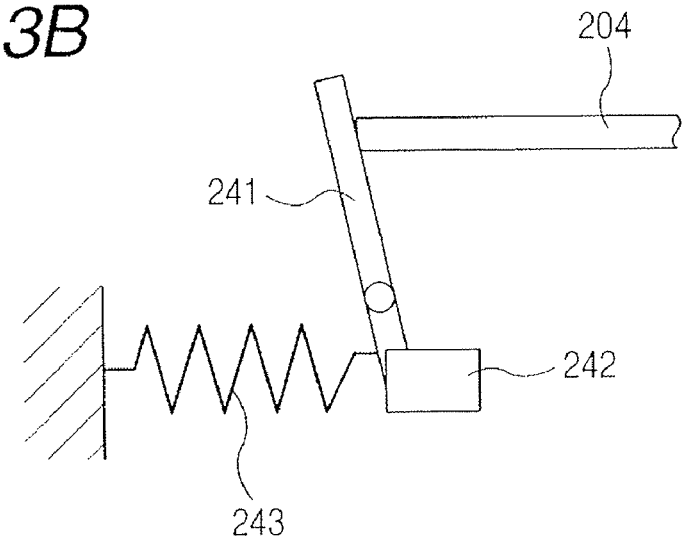
FIG. 3B is a schematic view of the deviation detecting sensor when it has detected the pressure belt.

The deviation detecting sensors 240*a* and 240*b* are of a construction as shown in FIGS. 3A and 3B wherein a pivotally movable flag 241 and a transmission type optical sensor 242 are combined together. The pivotally movable flag 241 is biased into contact with the side edges 204*a* and 204*b* of the pressure belt 204 by a spring 243. The deviation detecting sensors 240*a* and 240*b* can detect the deviation of the pressure belt 204 by the movement of the pivotally movable flag 241. As the deviation detecting sensors, use may be made of transmission type optical sensors or reflection type optical sensors.

In a case where the deviation detecting sensors 240*a* and 240*b* are disposed so as to operate integrally with the pressure unit 24B, the deviation detecting sensors 240*a* and 240*b* can be opposed to the pressure belt 204 substantially in the same state to thereby improve the accuracy thereof for detecting the pressure belt 204. Also, the deviation detecting sensors 240*a* and 240*b*, when provided discretely from the pressure unit 24B, can be made irrelative to the pressure releasing operation of the pressure belt 204 to the fixing roller 201, and the influence of the force during the pressure release can be mitigated.

(Pressure/Pressure Releasing Mechanism of the Pressure Unit)

Further, the belt conveying apparatus 33 has a pressure/pressure releasing mechanism as moving means for moving the pressure unit 24B. This pressure/pressure releasing mechanism has the function of moving the pressure unit so that the pressure belt can assume a position in which the pressure belt is brought into pressure contact with the fixing roller and can carry out the fixing process (image heating process), and a position in which the pressure belt is retracted (spaced apart) from the fixing roller.

This pressure/pressure releasing mechanism has a release cam 208. The pressure unit 24B is supported by the pivot shaft 209 and the release cam 208. The pressure unit 24B, when the release cam 208 is rotated, can be rotated about the pivot shaft 209 to thereby perform the pressurizing operation/pressure releasing operation of the pressure belt 204 to the fixing roller 201.

The deviation control device 230 is disposed on the pressure unit 24B. That is, the deviation control device 230 is fixed to the supporting metal plate 205 supported by the pivot shaft 209 of the pressure unit 24B and therefore is adapted to tilt integrally with the pressure unit 24B.

The fixing apparatus 24 provided with the above-described belt conveying apparatus 33 urges the pressure belt 204 of the pressure unit 24B against the fixing roller 201 of the fixing unit 24A to thereby form a fixing nip portion between the fixing roller 201 and the pressure belt 104. The fixing nip portion, when a recording material S bearing an unfixed toner image thereon is conveyed thereto, nips and heats the sheet together with the toner image. The recording material S is pressurized and heated, whereby the toner image thereon is fixed.

(Deviation Controlling Operation of the Pressure Belt)

The deviation controlling operation of the pressure belt 204 will now be described in detail.

The controlling portion 244 obtains the position (deviation) information of the belt from the deviation detecting sensors 240*a* and 240*b*, and displaces one end side of the tension roller 203, namely, controls the inclination of the tension roller 203. The inclination of the tension roller 203 is performed by moving only the end portion 203*a* on this side of the tension roller 203 up and down by the deviation control arm 231 rotated in a vertical direction by the deviation control driving portion 232.

Figure 1:
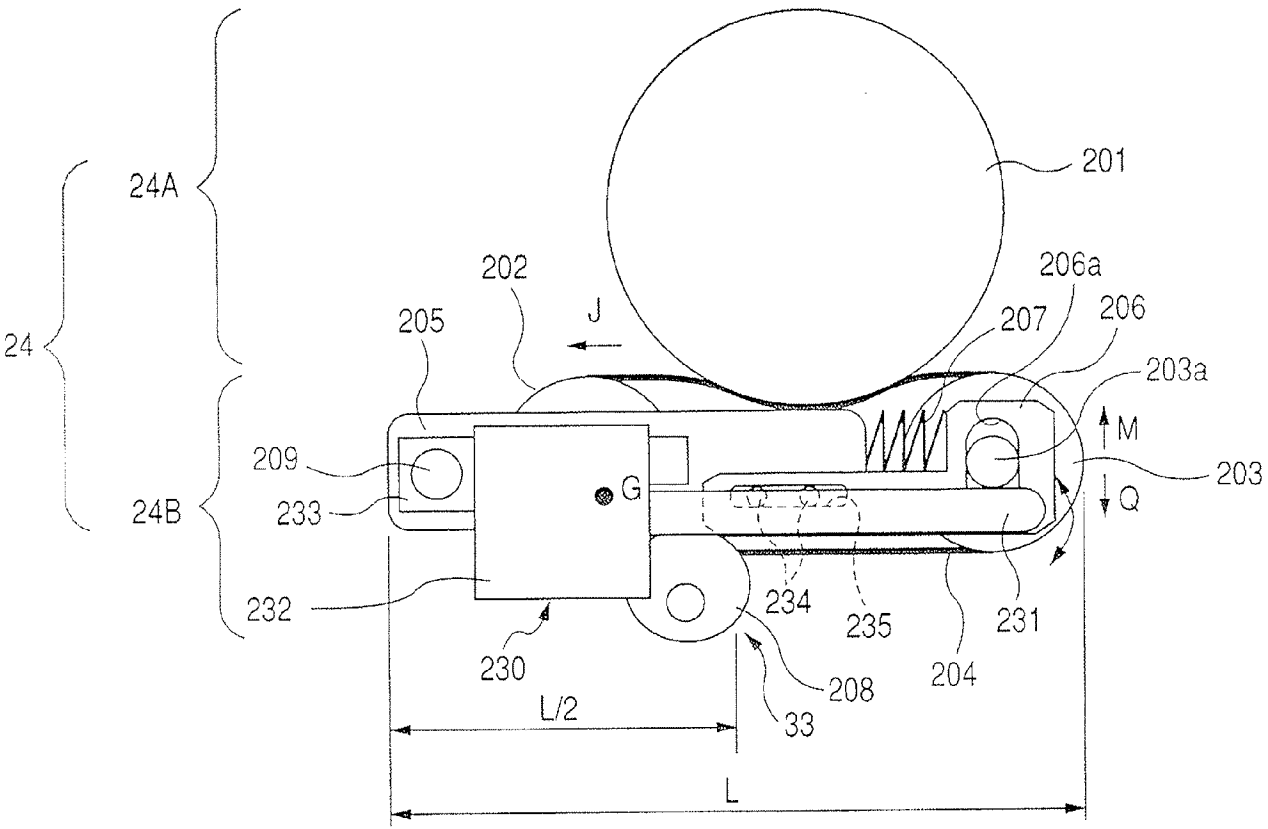
FIG. 1 is a front view of a fixing apparatus as an image heating apparatus according to an embodiment of the present invention.

When the pressure belt 204 is rotated in the direction indicated by the arrow J (see FIG. 2) and deviates in the direction indicated by the arrow K, the deviation detecting sensor 240*a* detects the side edge 204*a* of the pressure belt 204 and detects the deviation of the pressure belt 204. On the basis of the result of the detection, the controlling portion 244 controls the operation of the deviation control driving portion 232 to thereby rotate the deviation control arm 231 by a predetermined value in a counter-clockwise direction as viewed in FIG. 1. Thereupon, the end portion 203*a* on this side of the tension roller 203 rises in the direction indicated by the arrow M as shown in FIG. 1, and the pressure belt 204 deviates in the direction indicated by the arrow M (see FIG. 2).

The end portion 203*b* on the inner part side of the tension roller 203 is tiltably fixed to the slide metal plate 206 disposed on the inner part side. The end portion 203*a* on this side of the tension roller 203 is vertically movable through a longitudinal slot 206*a* (see FIG. 1) as the accommodation mechanism of the slide metal plate 206. Accordingly, the tension roller 203 is designed such that the end portion 203*a* on this side thereof is vertically moved with the end portion 203*b* on the inner part side as a fulcrum and the tension roller 203 is inclined as a whole.

When the pressure belt 204 deviates in the direction indicated by the arrow N, the deviation detecting sensor 240*b* (see FIG. 2) detects the other side edge 204*a* of the pressure belt 204. On the basis of the result of the detection, the controlling portion 244 controls the operation of the deviation control driving portion 232 to thereby rotate the deviation control arm 231 by a predetermined value in a clockwise direction as viewed in FIG. 1. Thereupon, the end portion 203*a* on this side of the tension roller 203 is lowered in the direction indicated by the arrow Q as shown in FIG. 1, and the pressure belt 204 deviates in the direction indicated by the arrow K.

The belt conveying apparatus 33 continues the operation of moving the end portion 203*a* on this side of the tension roller 203 up and down while the pressure belt 204 is circulating, whereby it can fluctuate the pressure belt in the width direction of the pressure belt. That is, it can rotate the pressure belt 204 while maintaining the pressure belt 204 in a predetermined area so as not to come off from the suspension roller.

In FIG. 1, the belt conveying apparatus 33, when it moves the pressure belt 204 toward the fixing roller 201 to thereby strengthen the pressure force of the nip portion, rotates the release cam 208 which is a pressure releasing mechanism to thereby move the supporting metal plate 205 and the slide metal plate 206 toward the fixing roller 201. Thereupon, the suspension roller 202 is elevated integrally with the supporting metal plate 205. The deviation control device 230 is also elevated integrally with the supporting metal plate 205. At this time, the deviation control arm 231 of the deviation control device 230 receives the end portion 203*a* on this side of the tension roller 203. Therefore, the deviation control arm 231 of the deviation control device 230 elevates the end portion 203*a* on this side of the tension roller 203 integrally therewith. That is, the entire tension roller 203 is also elevated while the inclined state of the tension roller 203 relative to the suspension roller 202 is maintained.

Thus, the whole including the suspension roller 202, the tension roller 203, the pressure belt 204, the supporting metal plate 205, the slide metal plate 206 and the deviation control device 230 is intactly elevated.

Also, electric power is given to the deviation control driving portion 232 of the deviation control device 230 by a conductor (not shown) and the conductor can be wired longer with an extra length to thereby give electric power to the deviation control driving portion 232 even if elevated.

As the result, the belt conveying apparatus 33 can adjust the pressure force of the pressure belt against the fixing roller 201 without the deviation adjustment by the deviation control device 230 being brought out of order, and unlike the conventional art, the deviation adjustment need not be performed again.

Also, even if in the state of FIG. 1, the deviation adjustment by the deviation control device 230 is performed, the deviation control arm 231 is operated and the end portion 203*a* on this side of the tension roller 203 is only moved up and down and the positions of the other portions are kept as they are. Therefore, the fixing apparatus 24 does not require the pressure force of the pressure belt against the fixing roller 201 to be readjusted.

Figure 4:
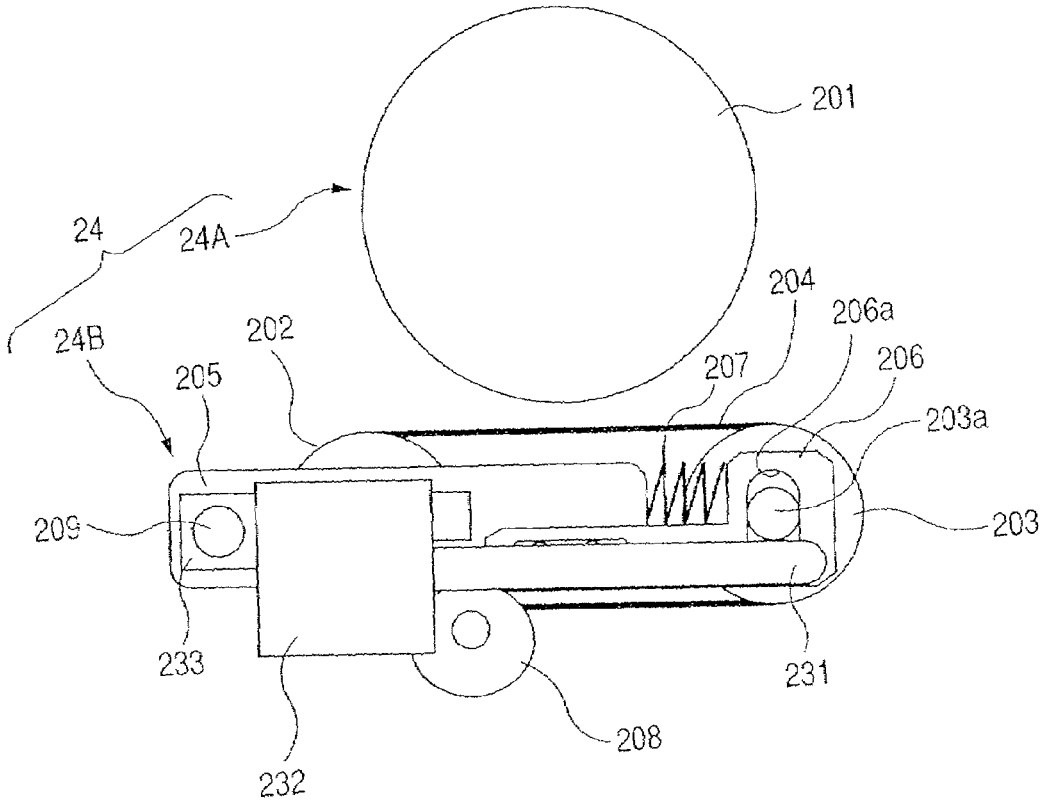
FIG. 4 shows a state in which a pressure unit is separated from a fixing unit in FIG. 1.

Also, as shown in FIG. 4, it is sometimes the case with the fixing apparatus 24 that the pressure unit 24B is downwardly pivotally moved to thereby separate the pressure belt 204 from the fixing roller 201. Even if in this state, the inclination of the tension roller 203 is changed by the deviation control arm 231 to thereby perform the deviation adjustment of the belt, whereafter the pressure unit 24B is again elevated to thereby pressurize the pressure belt 204 against the fixing roller 201, it will never happen that the deviation adjustment gets out of order. While in FIG. 4, the pressure belt 204 is completely separate from the fixing roller 201. But the pressure belt 204 may be sometimes more or less in contact with the fixing roller 201. Again even in this case, it never happens that the deviation adjustment gets out of order.

As described above, the belt conveying apparatus 33 can stably perform the deviation adjustment because even if the pressure unit 24B is tilted by the rotation of the release cam 208, the relative positional relation between the tension roller 204 and the deviation control arm 231 of the deviation control device 230 is not changed.

If like the fixing roller 201 of the belt conveying apparatus 33, the nip forming member is an elastic member, the amount of crush (deformation) of the fixing roller differs depending on the pressure force and therefore, it is conceivable that the position of the tension roller 203 is also varied by the fluctuation of pressure, as by the pressure releasing operation. However, the belt conveying apparatus 33 can stably perform the deviation control of the belt because the positional relation between the deviation control device 230 and the tension roller 203 does not change.

Further, the belt conveying apparatus 33 is designed such that depending on the kind of the sheet, the controlling portion 244 adjusts the pressure force of the pressure belt 204 against the fixing roller 201. Generally, thin paper is good in the fixing property for a toner image, but is liable to be curled. Also, thick paper is bad in the fixing property for a toner image, but is difficult to curl. Therefore, the fixing apparatus 24 provided with the belt conveying apparatus 33 which can adjust the pressure force of the pressure belt 204 against the fixing roller 201 depending on the kind of the sheet can reliably perform the fixing of a toner image at low pressure in the case of thin paper, and at high pressure in the case of thick paper.

While the pressure belt is suspended on two rollers, the number of rollers is not restricted to two, but may be three or more. Again in this case, a similar effect is obtained.

Also, while rollers have been shown as the suspension members, sliding members may be used instead of the rollers.

In the foregoing, description has been made of an example in which the present invention is applied to the pressure belt, but when a fixing belt is used instead of the above-described fixing roller, there may be adopted a construction in which the present invention is applied to this fixing belt.

Furthermore, while in the foregoing, description has been made with the fixing apparatus taken as an example of the image heating apparatus, it is also possible to apply the present invention to a gloss improving apparatus for heating an image fixed on a recording material to thereby improve the degree of glossiness of the image.

Also, while the foregoing belt conveying apparatus has been described with respect to an example in which it is used in a fixing apparatus, the present invention can also be applied to the following case. It is, for example, a case where the belt conveying apparatus is applied to an intermediate transfer belt as an image receiving member to which a toner image on an image bearing member (photosensitive member) in an image forming apparatus is transferred, instead of the above-described "pressure belt".

As described above, the fixing apparatus 24 is provided with the above-described belt conveying apparatus 33 and therefore, the regulation of the pressure force of the belt against the fixing roller 201 and the adjustment of the circulation position of the belt can be performed without being affected by each other, and the regulation and the adjustment can be performed quickly. Consequently, the fixing apparatus 24 can easily perform the fixing regulation of a toner image on a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-266117, filed Sep. 13, 2005, which is hereby incorporated by reference herein in its entirety.

What is claimed is:

1. An image heating apparatus comprising:

a heating rotary member, which heats an image on a recording material in a nip portion;

a belt unit provided with an endless belt forming said nip portion between said endless belt and said heating rotary member, and a supporting member for supporting an inner surface of said endless belt; and a displacement mechanism, which displaces said supporting member so that said endless belt is moved in a width direction of said endless belt, said displacement mechanism being provided with a moving member configured to move said supporting member and a driving motor that moves said moving member, wherein when said belt unit is moved to a position retracted from a position for heating the image, said displacement mechanism is moved with said belt unit.

2. An image heating apparatus according to claim 1, wherein said displacement mechanism is disposed on said belt unit.

3. An image heating apparatus according to claim 1, wherein when said belt unit is in the retracted position, said apparatus is capable of executing a mode in which said endless belt is rotated.

* * * * *